US006308650B1

(12) United States Patent
Tsumiyama et al.

(10) Patent No.: US 6,308,650 B1
(45) Date of Patent: Oct. 30, 2001

(54) HATCH COVER STRUCTURE FOR PERSONAL WATERCRAFT

(75) Inventors: Yoshinori Tsumiyama, Miki; Kenichi Nakagawa; Masafumi Ikeyama, both of Kobe, all of (JP)

(73) Assignee: Kawasaki Jukogyo Kabushiki Kaisha, Kobe (JP)

( * ) Notice: Subject to any disclaimer, the term of this patent is extended or adjusted under 35 U.S.C. 154(b) by 0 days.

(21) Appl. No.: 09/352,492

(22) Filed: Jul. 13, 1999

(30) Foreign Application Priority Data

Jul. 13, 1998 (JP) ..... 10-197083

(51) Int. Cl.[7] ..... B63B 35/73
(52) U.S. Cl. ..... 114/55.53; 49/248
(58) Field of Search ..... 16/354, 364, 368; 49/246, 248, 250; 114/55.53, 201 R; 180/69.21; 296/76

(56) References Cited

U.S. PATENT DOCUMENTS 2,668,320 * 2/1954 Lustig ..... 16/289
3,101,135 * 8/1963 Neal et al. ..... 49/248
3,113,339 * 12/1963 Krause ..... 16/288
3,367,067 * 2/1968 Noll ..... 49/98
3,838,537 * 10/1974 Stavenau et al. ..... 49/248
4,644,891 * 2/1987 Niina ..... 114/201 R
4,727,622 * 3/1988 Tsuneki ..... 16/368
4,738,003 * 4/1988 Mori et al. ..... 16/321
4,986,208 * 1/1991 Kobayashi ..... 114/55.53
5,435,406 * 7/1995 Gaffoglio et al. ..... 180/69.21
5,500,985 * 3/1996 Klueger ..... 16/354
5,588,887 * 12/1996 Ikeda ..... 440/88

FOREIGN PATENT DOCUMENTS 7-45428 10/1995 (JP) .
1474022 * 4/1989 (SU) ..... 114/201 R

* cited by examiner

*Primary Examiner*—S. Joseph Morano
*Assistant Examiner*—Andy Wright
(74) *Attorney, Agent, or Firm*—Marshall, Gerstein, & Borun

(57) ABSTRACT

A hatch cover structure for a personal watercraft, wherein a hatch cover is attached to a deck of the personal watercraft via a hinge unit having a double action mechanism, which moves the hinge shafts apart from a hull surface during the continued opening action of the pivotally moving hatch cover.

6 Claims, 11 Drawing Sheets

(a)

(b)

HATCH COVER STRUCTURE FOR PERSONAL WATERCRAFT

BACKGROUND OF THE INVENTION

1. Field of the Invention

The present invention relates to a hatch cover structure for a personal watercraft planing on a water surface and more particularly to a hinge structure of the hatch cover.

2. Description of the Related Art

In recent years, a personal watercraft has become popular for use in leisure or sports.

Accordingly, a high fashionability (functional beauty) in external appearance is required for the personal watercraft, in addition to its high performance.

The personal watercraft is, in general, smaller in size than a leisure motorboat or the like, and is difficult to ensure a large-capacity accommodating space in one place. Therefore, an empty space in a front or rear portion of the watercraft is utilized as the accommodating space. As an example, a hatch cover is located in the front portion of the watercraft and the accommodating space is provided under the hatch cover. A prior art configuration of this type is disclosed in Japanese Utility Model Publication No. 7-45428.

Moreover, in order to provide a desirable appearance and to reduce fluid resistance, the personal watercraft is formed substantially in a bullet shape. Therefore, a deck of the watercraft and the hatch cover disposed thereon are required to be formed as a continuous streamlined shape.

The above described hatch cover arranged in the front portion of the watercraft, has a hinge unit usually located near the front tip (bow) of the deck, and the hatch cover is pivoted at the front end thereof to be opened forwardly. In this structure, a design of the bow is mechanically limited in some degrees. In other words, the size of the hinge unit is limited when the hinge unit is positioned on the front end of the hatch cover, because the watercraft is formed in bullet shape as described above, and the width is limited for providing the hinge unit at front end of the hatch cover. As a result, the hatch cover is limited in a shape and a degree of design freedom. For this reason, the hinge shaft (rotating shaft) of the hinge unit is usually positioned rearward from the front end of the hatch cover. In this structure, a recess of a small radius must be formed in the deck to avoid contact with the front portion of the hatch cover when the hatch cover is opened, because it is desirable there is no gap between the hatch cover and the deck when the hatch cover is closed. Forming a recess of small radius in the three-dimensionally narrow portion of bow of the deck, makes the shape of the bow complicated, and requires troublesome work in FRP (Fiber Reinforced Plastics) molding in the manufacturing process.

SUMMARY OF THE INVENTION

An object of the present invention is intended to overcome disadvantages by providing a hatch cover structure for a personal watercraft having a hinge structure without producing any noticeable gap between a hatch cover and a deck, and without forming a recess of a small radius on the front portion of the deck to which the hatch cover is attached as described above.

According to the present invention, there is provided a hatch cover structure for a personal watercraft in which a hatch cover is attached openably on a surface of a deck of the personal watercraft through a hinge unit, including a double action mechanism which moves the hinge shaft apart from the surface of the deck associating with the progress of the opening action of the hatch cover.

With this structure, the front portion of the hatch cover is avoided to move into contact with the deck when the hatch cover is opened, and any noticeable gap is not formed between the deck and the hatch cover in a closed state, even when the hatch cover is attached to the deck through the hinge unit with the hinge shaft positioned rearward of the front end of the hatch cover.

In one embodiment of a hatch cover structure for a personal watercraft, the double action mechanism is constructed by a mechanism having a pair of gears and a link mechanism. The double action mechanism comprises a gear frame, a pair of gears which engage each other, and arranged in said gear frame, a first link member having a fixed end and a free end, said fixed end being secured to one gear of said pair of gears, a second link member having a fixed end and a free end, said fixed end being secured to the other gear of said pair of gears, a third link member having a free end and a fixed end, said free end being pivotally connected to said free end of said second link member, a connecting element disposed at said free end of said first link member, said connecting element serves as a hinge shaft, said gear frame is fixed to one of one surface of the deck and one surface of the hatch cover, and the free end of said first link member and the fixed end of said third link member are pivotally attached to one of the other surface of the deck and the other surface of the hatch cover, whereby the hinge shaft moves apart from the surface of the deck with the progress of the opening action of the hatch cover. The use of the pair of gears allows a high rigidity and smooth operation of the hatch cover structure.

In the above embodiment, an effective length of the first link member is smaller than the sum of the effective lengths of the second and third link members, and the pair of gears are substantially equal in the number of teeth. With the structure described above, the hatch cover structure is realized in which the hatch cover is pivoted at its front portion and opened forwardly in a predetermined manner. That is, the factors of an angle of inclination of the hatch cover is determined by: the difference between the length of the first link member and the sum of the lengths of the second and third link members, the distance between the free end of the first link member and the fixed end of the third link member, and the distance between the fixed end of the first link member attached to the first gear and the fixed end of the second link member attached to the second gear. Thus, the above preferable embodiment is obtained.

In the second embodiment, the double action mechanism is composed of a link mechanism and a slide mechanism. The double action mechanism includes a second link member whose fixed end is connected to the deck through a second connecting element and whose free end is slidably connected to the hatch cover through a slide mechanism, a first link member whose fixed end is connected to the deck through a third connecting elements, and a free end is connected to the hatch cover, through a first connecting element, and a slider which is slidably connected to the intermediate position of the first link member and connected to the intermediate position of the second link member, whereby the first connecting element which connects the first link member with the hatch cover, serves as a hinge shaft which is moved apart from the surface of the deck associating with the progress of opening action of the hatch cover. With this structure, the hinge unit is compactly housed in the tip portion of the hatch cover, and it is thus possible to ensure a wide inward space (housing space) for accommodating baggage or the like when the hatch cover is opened.

In the embodiment having the link members and the slider, the first link member and the slider are connected to each other by the connection of an elongated hole which extends longitudinally in the first link member, and the slider which is slidably in the elongated hole. With this construction of forming the elongated hole in the first link member, the double action mechanism can be made compact.

In any one of the above-mentioned hatch cover structures, superior embodiment is obtained when an attaching member is integrally provided with the double action mechanism on the hatch cover side, because the attaching member increases rigidity of the hatch cover structure which permits reduction of the thickness of the hatch cover itself.

These objects as well as other objects, features and advantages of the present invention will become apparent to those skilled in the art from the following description with reference to the accompanying drawings.

DESCRIPTION OF THE PREFERRED EMBODIMENTS

A hatch cover structure for a personal watercraft according to the present invention will be described below with reference to the accompanying drawings.

Embodiment 1

Figure 1:
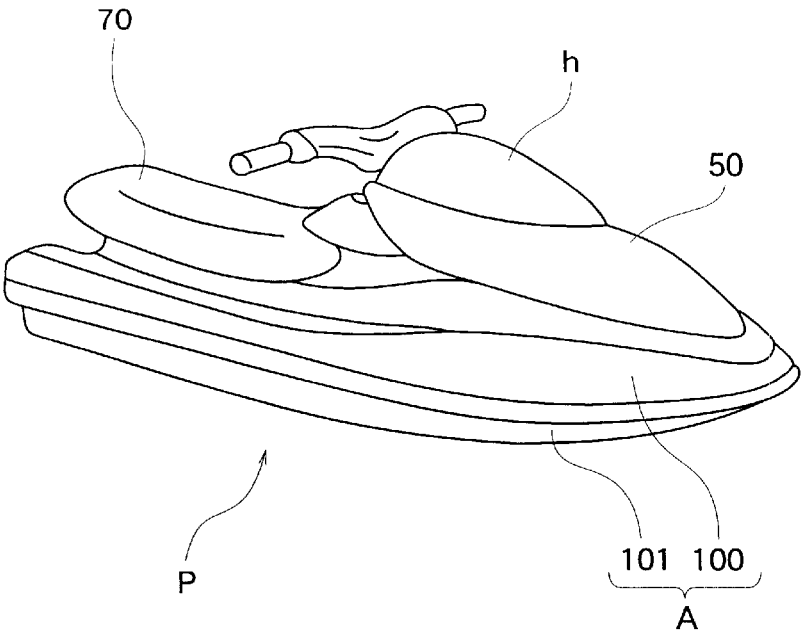
FIG. 1 is a perspective view of the personal watercraft having a hatch cover structure according to an embodiment of the present invention, wherein FIG. 1(*a*) shows the closed state and FIG. 1(*b*) shows the opened state of the hatch cover.
Figure 1:
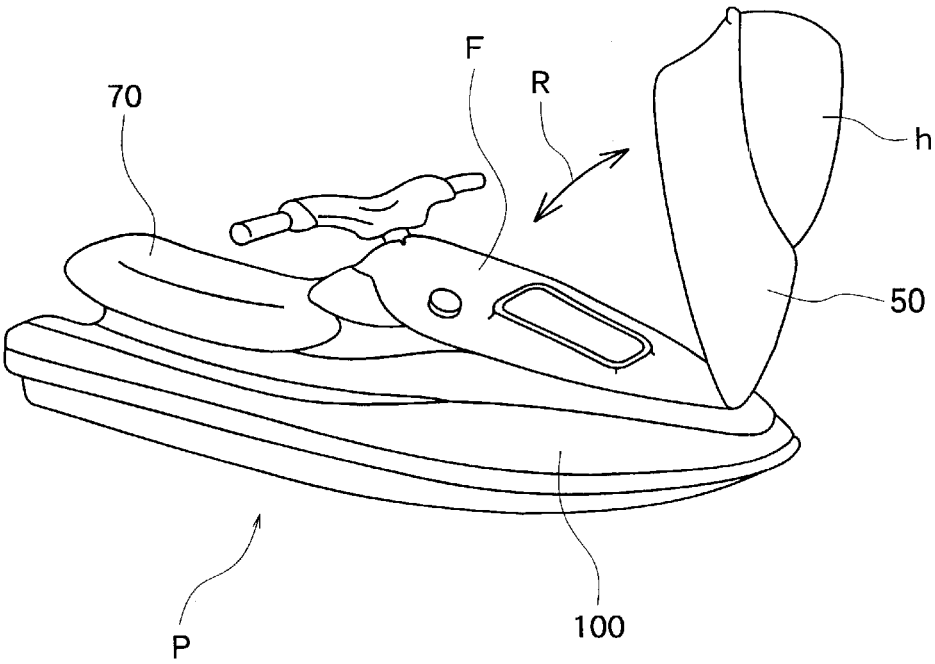
Figure 2:
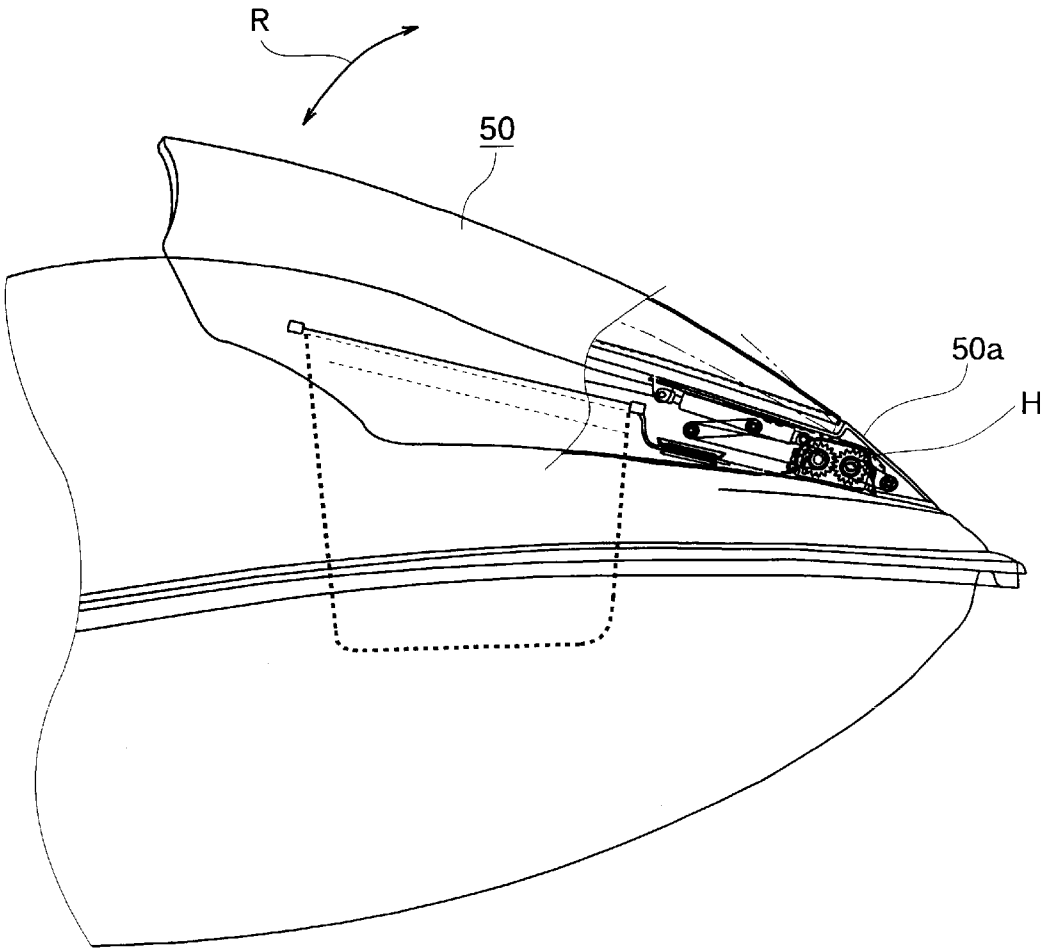
FIG. 2 is an enlarged side view of a bow portion of the personal watercraft shown in FIG. 1, partly broken away to show a main portion of the hatch cover structure.
Figure 3:
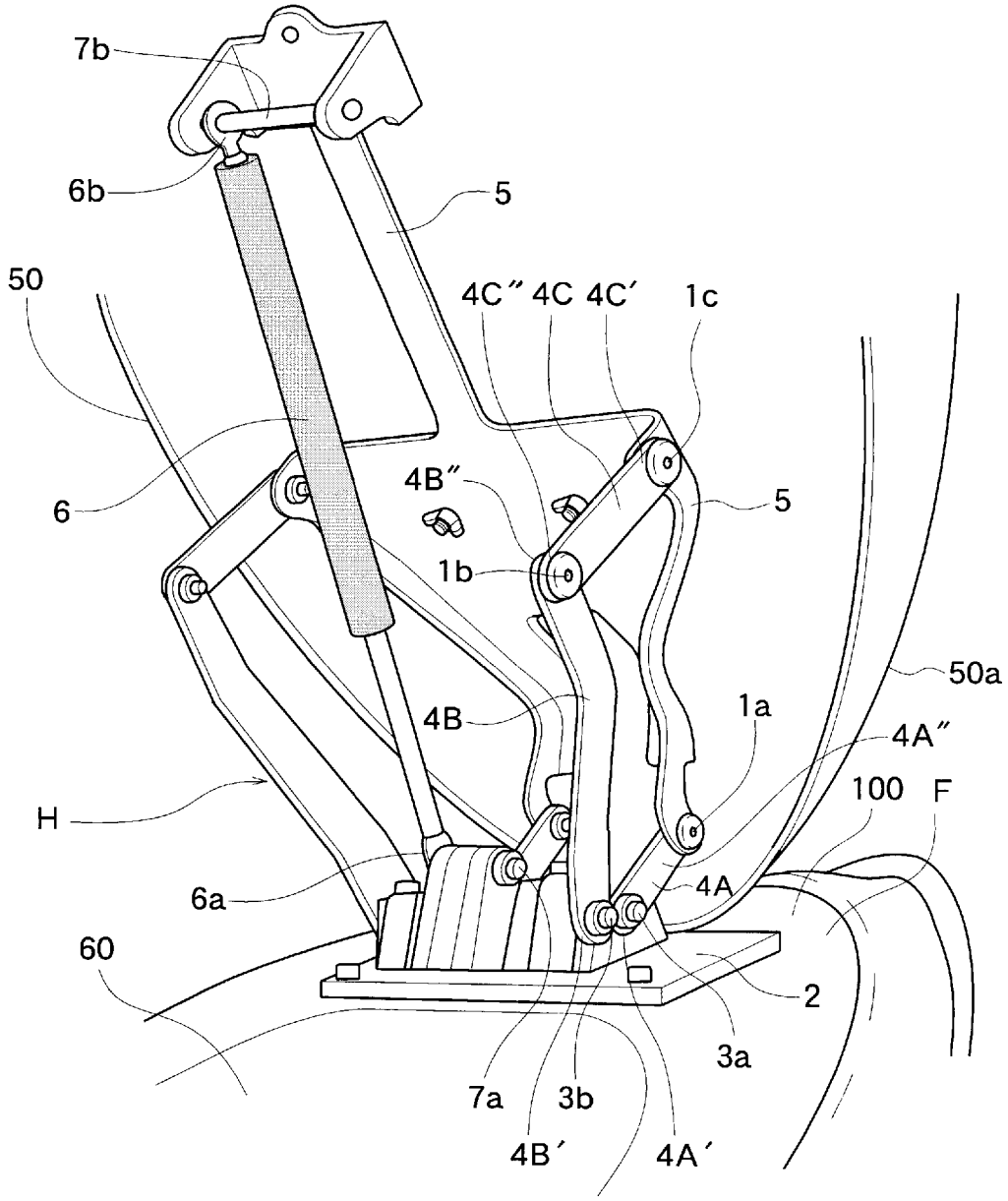
FIG. 3 is a perspective view of the main portion of the hatch cover structure shown in FIG. 2, seen diagonally behind the opened hatch cover.
Figure 4:
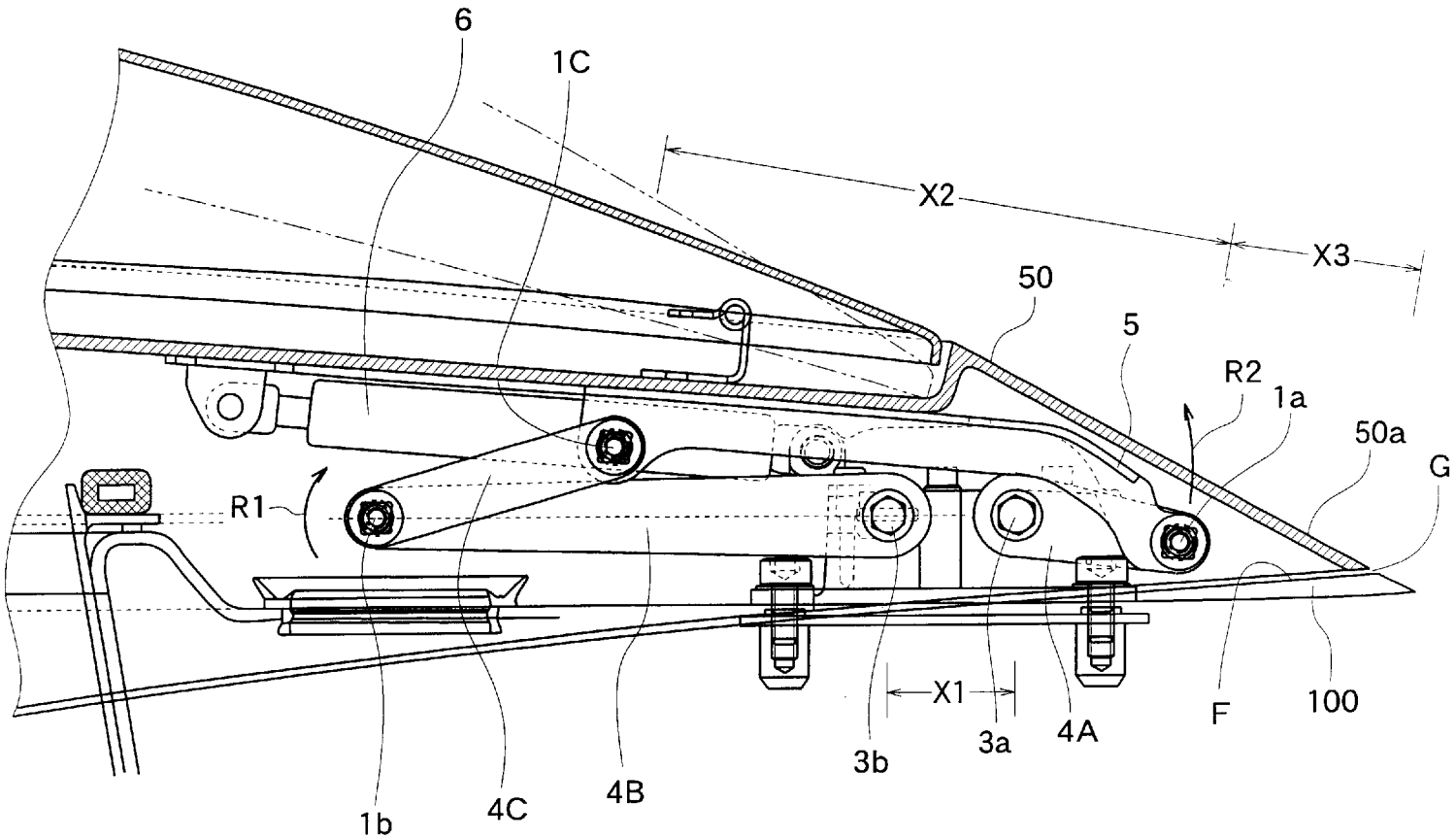
FIG. 4 is a partly broken side view of a hinge unit shown partially in cross section, with the hatch cover in closed state.
Figure 5:
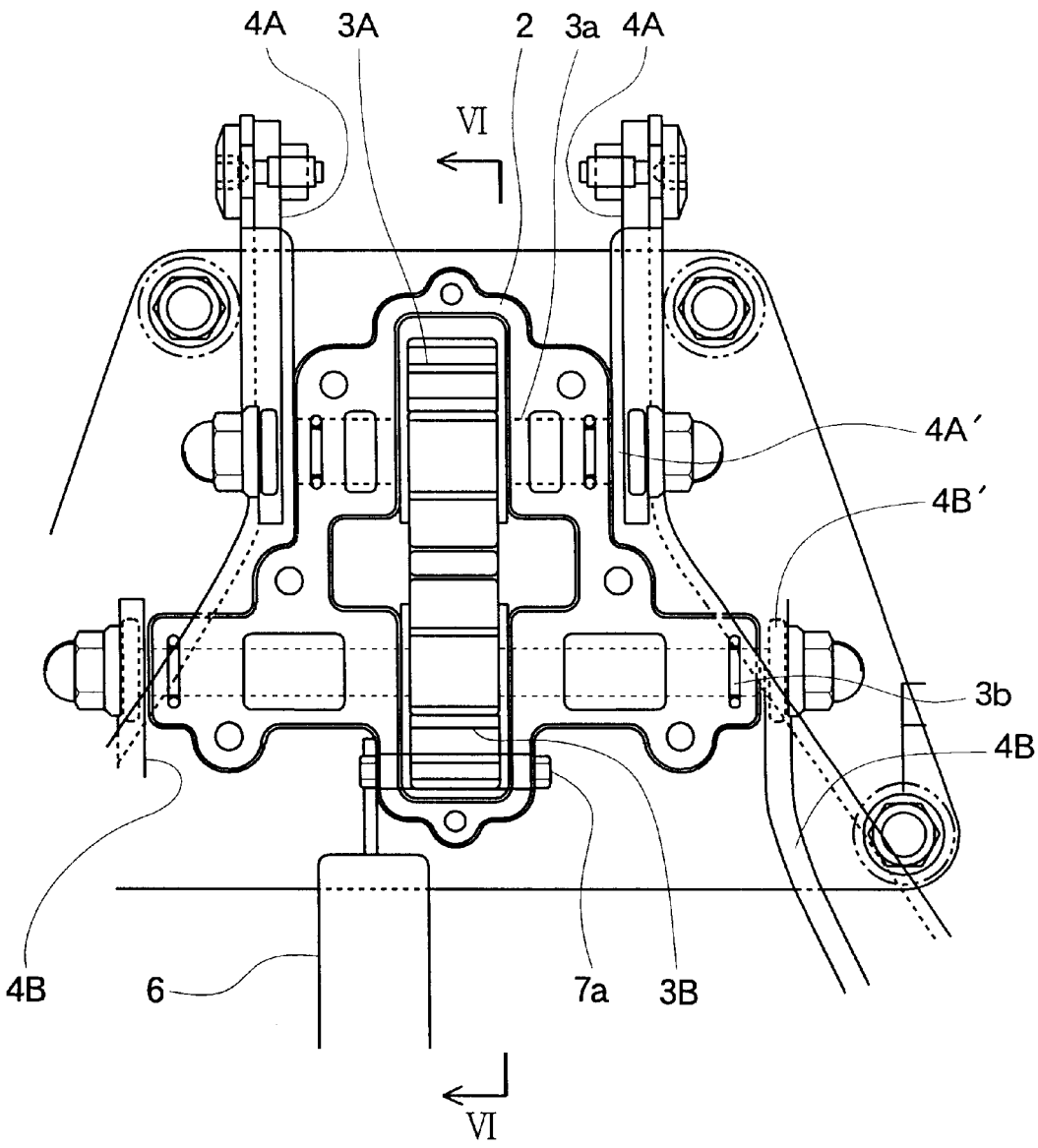
FIG. 5 is a enlarged plan view of a construction of the hinge unit and a shock absorber of the hatch cover shown in FIG. 4, with the hatch cover, an attaching member and the cover of gear frame removed.
Figure 6:
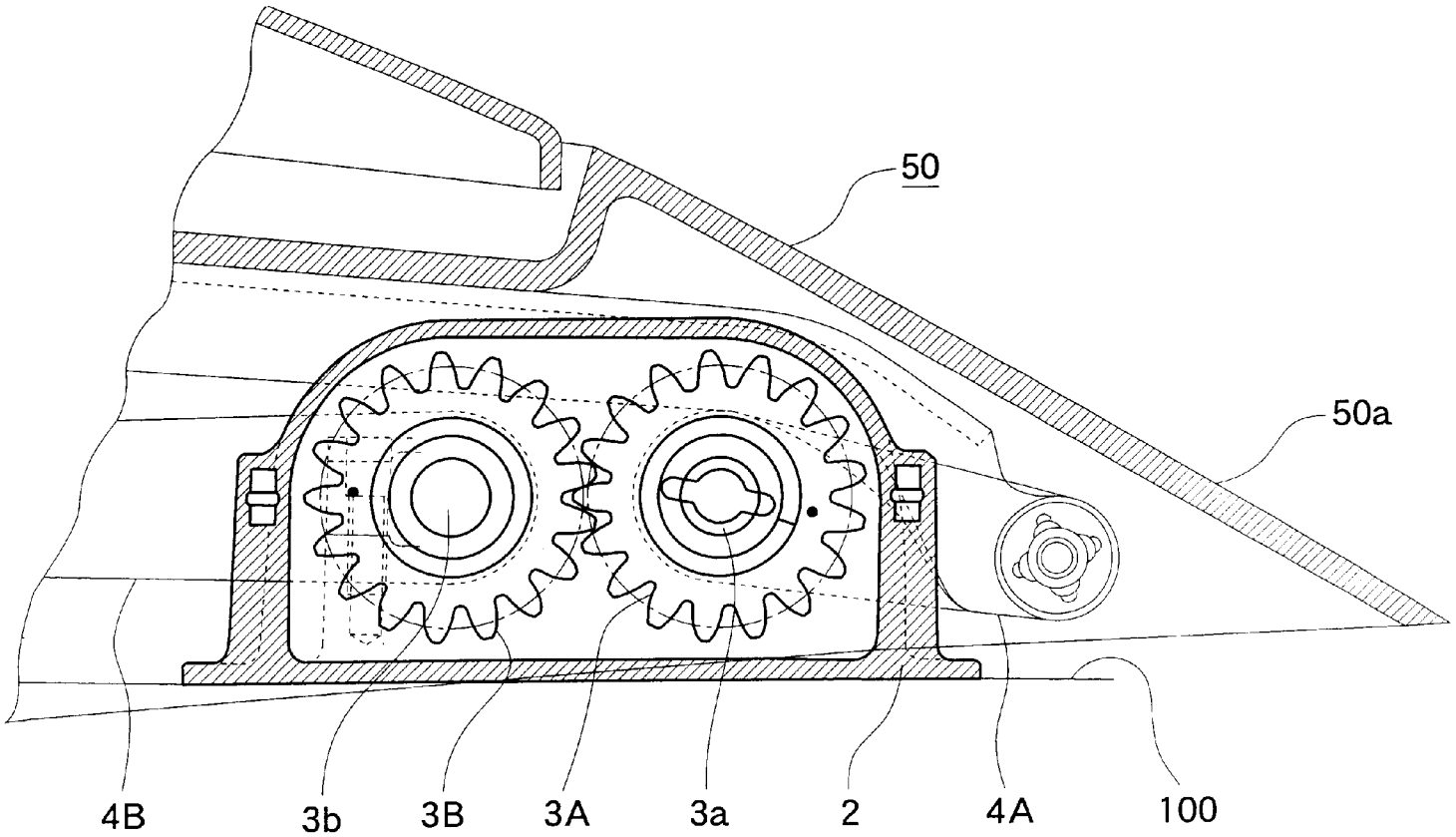
FIG. 6 is a side view taken on line VI—VI of FIG. 5, showing an engagement of a pair of gears in a gear frame.
Figure 7:
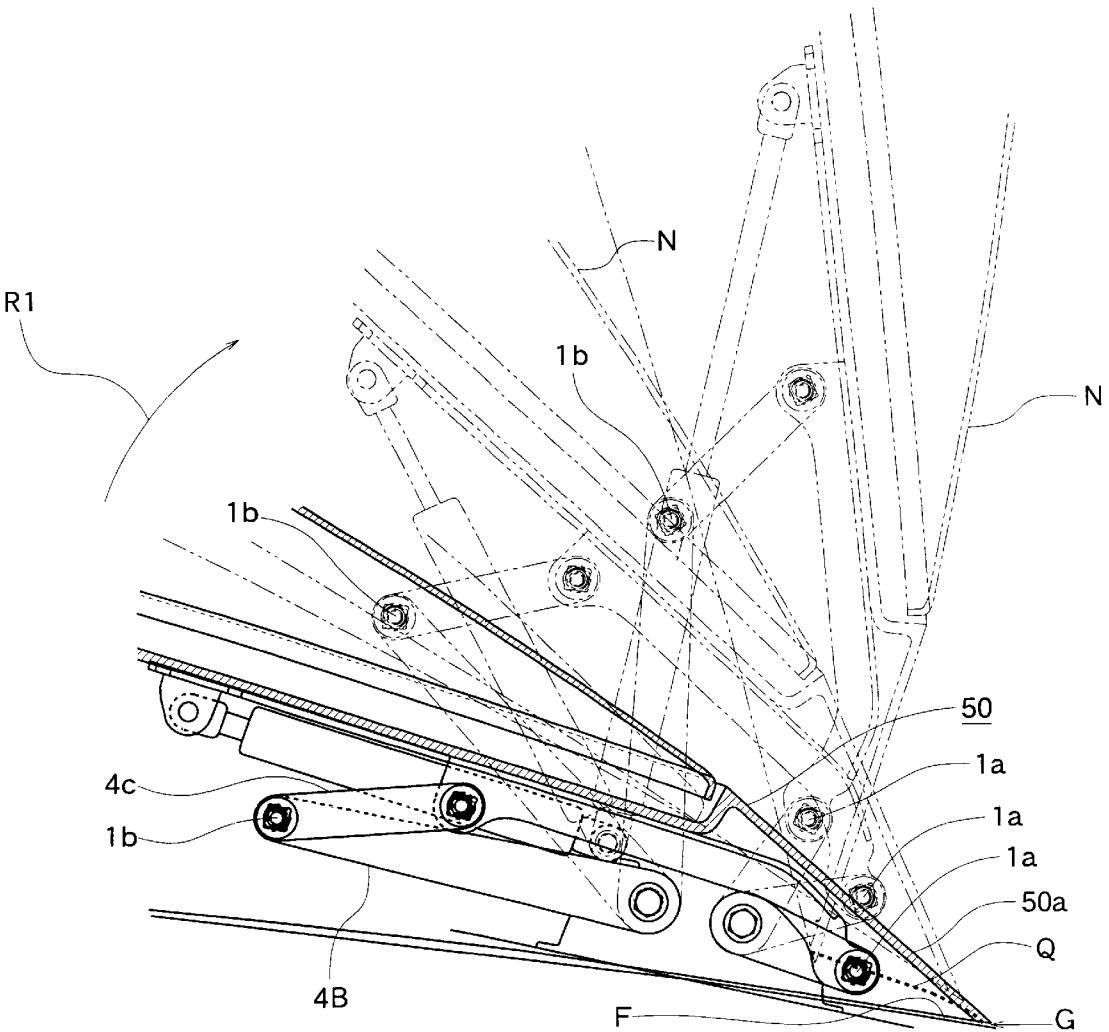
FIG. 7 is a sectional side view of an opening process of the hatch cover according to the embodiment shown in FIGS. 2 to 6.

FIG. 1 shows a general perspective view of the personal watercraft in which a hatch cover structure for a personal watercraft according to this embodiment is applied. FIG. 1(*a*) shows the closed hatch cover. FIG. 1(*b*) shows the opened hatch cover. FIG. 2 is an enlarged side view of a bow in which the hatch cover of the personal watercraft shown in FIG. 1 is disposed, partially broken away to show a main part. FIG. 3 is a perspective view of the main part of the hatch cover structure shown in FIG. 2 seen diagonally behind the opened cover. FIG. 4 is a partially side view of a hinge unit with the hatch cover closed, the hatch cover being broken away and partially shown in cross section. FIG. 5 is a partially enlarged plan view of a constitution of the hinge unit and a shock absorber of the hatch cover shown in FIG. 4, with the hatch cover, an attaching fitting and the cover on gears removed. FIG. 6 is a side view taken on line VI—VI of FIG. 5, showing an engagement of a pair of gears in a gear suspension frame. FIG. 7 is a sectional side view of an opening/closing process of the hatch cover according to the embodiment shown in FIGS. 2 to 6.

As shown in FIGS. 1(*a*) and 1(*b*), a body A of a personal watercraft consists of a hull 101 and a deck 100 disposed thereon, and a hatch cover 50 of an accommodating space pivoted at its front tip is arranged near a bow of the personal watercraft P. As shown in FIG. 2, the hatch cover 50 is openable in a direction indicated by an arrow R around a hinge shaft of a hinge unit H arranged in a tip portion 50*a*, a little inward from the tip of the hatch cover 50. As shown in FIG. 3 in enlarged scale, the hinge unit H includes a "double action mechanism," through which the hatch cover 50 is openable around the hinge shaft, (a first connecting pin 1*a* in this embodiment) which moves apart from an upper surface F of the deck 100 as the progress of opening action of the hatch cover 50. More specifically, as shown in FIG. 6 as a side view, a gear 3A and 3B which engaged each other are rotatably supported by a gear frame 2 fixed to the deck 100 by means of shafts 3*a* and 3*b* integrally secured to the gears 3A and 3B, respectively. In this embodiment, the gears 3B and 3A are identical having the equal number of teeth. The gears 3A and 3B rotate with the shafts 3*a* and 3*b* by a predetermined angle (about 60 degrees in this embodiment).

As shown in FIG. 5, a fixed end 4A' of a first link member 4A is integrally secured to the support shaft 3*a*. A fixed end 4B' of a second link member 4B is integrally secured to the support shaft 3*b*.

As shown in FIGS. 3 and 4, a free end 4A" of the first link member 4A is rotatably connected via the first connecting pin (the first connecting element) 1*a* to an attaching member 5 attached integrally on an inner surface of the hatch cover 50. A free end 4B" of the second link member 4B is rotatably connected to a free end 4C" of a third link member 4C through a second connecting pin (a second connecting element) 1*b*. The fixed end 4C' of the third link member 4C is rotatably connected via a third connecting pin (a third connecting element) 1*c* to the attaching member 5 at the position rearwardly apart (toward the rear of the deck of the watercraft) from the position of the connecting pin 1*a* (distance between the connecting pins 1*c* and 1*a* is equal to the length of the link member 4B in this embodiment).

As shown in FIGS. 3 and 5, the link members 4A to 4C connected by the connecting pins 1*a* to 1*c* are arranged on both the sides of the support shafts 3*a* and 3*b*, i.e., the link members 4A to 4C are arranged in pairs on both the left and right sides of the gears 3A and 3B. As a result, a firmly structured link mechanism is formed between the hatch cover 50 and the upper surface F of the deck 100.

The length of the first link member 4A is smaller than the sum of the lengths of the second link member 4B and the third link member 4C (the length described below means the effective length acting as the link mechanism). In this embodiment, when the length of the first link member 4A is 1 inch, the length of the second link member 4B is about 3 inches and the length of the third link member 4C is about 1.5 inches respectively, a distance X1 (see FIG. 4) between the support shaft 3*a* and 3*b* is about 0.6 inch, a distance X2 (see FIG. 4) between the connecting portion on the free end 4A" of the first link member 4A and the connecting portion on the fixed end 4C' of the third link member 4C is about 3.4 inches, and a distance X3 (see FIG. 4) from the first connecting pin 1*a* to the tip of the hatch cover 50 is about 1.2 inches. However, this ratio of dimensions may be changed depending on an overhang length from the first connecting pin 1*a* to the front end of the hatch cover 50, a dimension of a gap G formed between the upper surface of deck and the lower end of the hatch cover when the hatch cover 50 is closed, and a setting of an opening angle of the hatch cover 50.

A pair of second link members 4B are curved laterally at the middle portion in the direction to widen the space between free ends 4B", to avoid physical contact with a shock absorber 6 described below.

In this embodiment, a shock absorber 6 is arranged in the intermediate portion between the left and right second link member 4B and behind the gear frame 2, i.e., a lower end 6*a* of the shock absorber 6 is rotatably fixed to the intermediate portion of the fixed ends 4B' of the left and right second link members 4B through a connecting pin 7*a*, and an upper end 6*b* of the shock absorber 6 is rotatably fixed to the rear end of the attaching member 5 through a connecting pin 7*b*. The shock absorber 6 includes a coil spring (not shown), which biases the shock absorber toward the extending direction when the shock absorber 6 is shrunk, and also includes a hydraulic circuit having an orifice (not shown) which damps the extending and shrinking movement of the shock absorber 6.

In order to afford a rust-resistant function to the structure of this embodiment, the link members, the gear frame 2, and the connecting pins or the like, are made of stainless steel, and the gears 3A, 3B and the support shafts 3*a*, 3*b* are integrally formed and are made of plastic material. However, the materials of these members are not particularly limited.

According to the hatch cover structure thus constituted, the structure acts in the following manner. As shown in FIG. 4, small or no gap G is formed between the upper surface F of the deck 100 and the lower end of the hatch cover 50 in a "closed state" in which the hatch cover 50 is close to (or in contact with) the upper surface of the deck 100.

When opening the hatch cover 50 from the closed state, the hatch cover 50 tends to rotate around the first connecting pin 1*a* (the hinge shaft). The free end 4B" of the second link member 4B rotates clockwise in FIG. 4 (see an arrow R1 of FIG. 4) with respect to the fixed end 4B' (the support shaft 3*b*) through the third link member 4C associating with the progress of opening action of the hatch cover 50. This rotation of the second link member 4B allows the free end 4A" of the first link member 4A to be rotated counterclockwise in FIG. 4 (see an arrow R2 of FIG. 4) with respect to the fixed end 4A' through the gears 3A and 3B (FIGS. 5 and 6). Consequently, the connecting pin 1*a* arranged on the free end 4A" of the first link member 4A gradually moves upward, i.e., in the direction in which it is moved away from the upper surface F of the deck 100, in the progress of the opening action. More particularly, as the progress of the opening action of the hatch cover 50 is shown by a dash and two dot line N in FIG. 7, the front end of the tip portion 50*a* of the hatch cover 50 which rotates around the connecting pin 1*a* moves upward at first by the opening action of the hatch cover 50 (rotating clockwise as indicated by the arrow R2 in FIG. 4), and then moves rearward above the upper surface F of the deck (see a dotted line Q in FIG. 7). Thus, the front tip of the hatch cover 50 does not move into contact with the upper surface of the deck, unlike the conventional hinge unit without a double action mechanism. Therefore, the hatch cover 50 takes the opening action smoothly relative to the upper surface F of the deck even when the gap G is very small.

As shown in FIG. 4, the hatch cover structure of this embodiment is made compact as a whole, because the shock absorber 6 is accommodated in an empty space of the link mechanism when the hatch cover 50 is closed.

As shown in FIG. 3, the hinge unit H does not hinder the taking in and out of the baggage through an opening 60 under the hatch cover 50 when the hatch cover 50 is opened, because the hinge unit H is compactly positioned in the tip portion 50*a* of the hatch cover 50.

Although the gear frame 2 is attached to the deck in this embodiment, the gear frame 2 can be alternatively secured to the hatch cover 50 and the attaching member 5 connecting the link members 4A and 4C can be disposed on the deck.

Embodiment 2

Another favorable embodiment will be described hereinafter with reference to FIGS. 8 to 11, wherein the hinge unit H having the double action mechanism is composed of a link mechanism and a slide mechanism.

Figure 8:
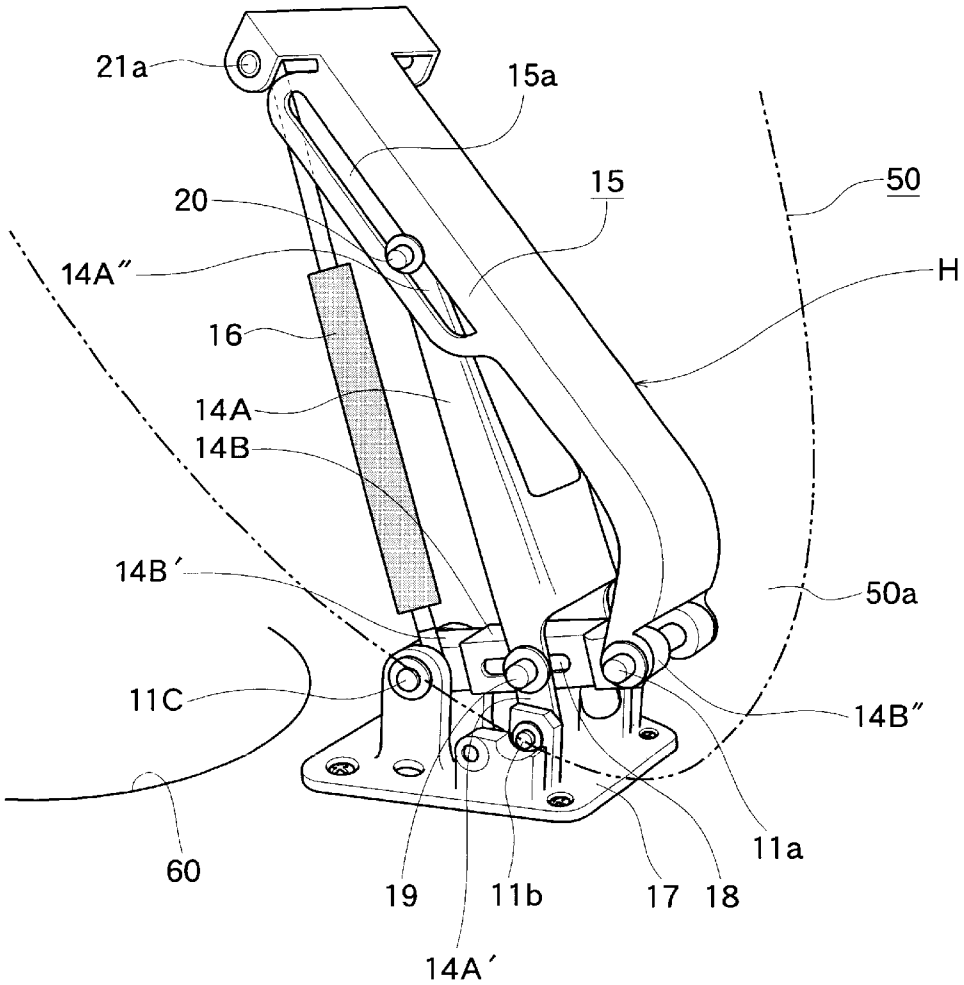
FIG. 8 is a perspective view of the main part of the hatch cover structure according to a second embodiment seen diagonally in the front of the opened hatch cover.
Figure 9:
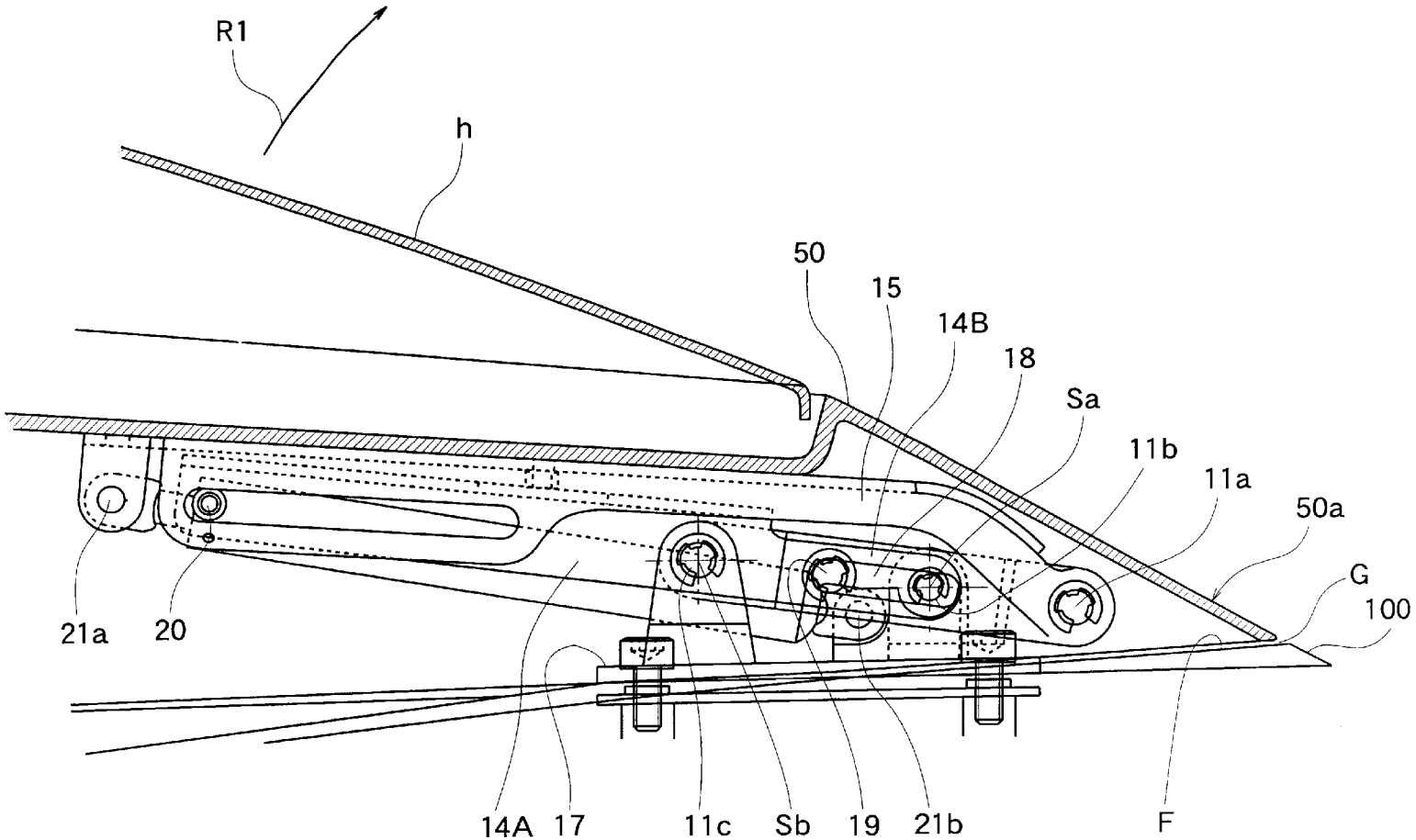
FIG. 9 is a side view of the hinge unit of the embodiment shown in FIG. 8 shown partially in cross section with the hatch cover in opened state.
Figure 10:
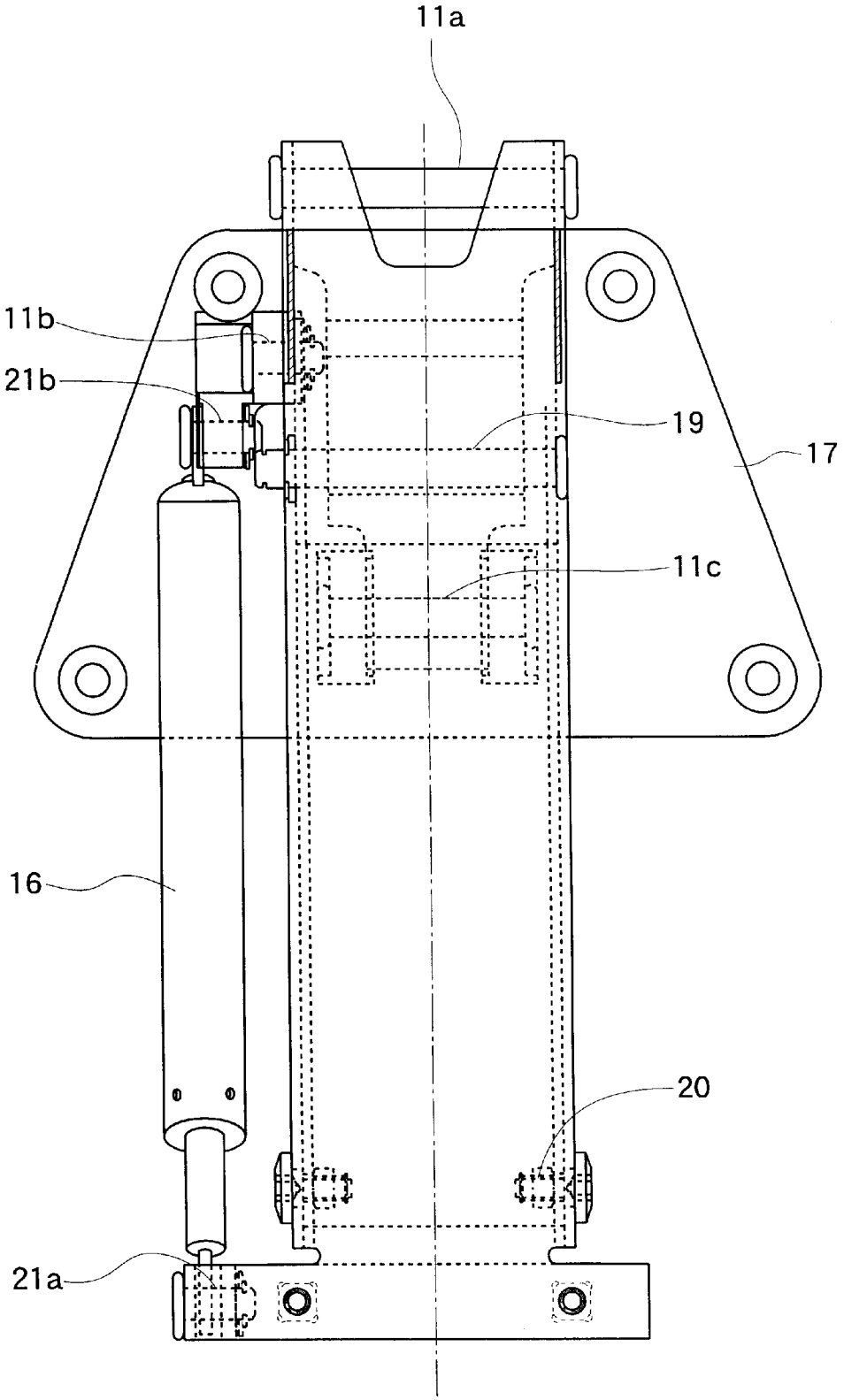
FIG. 10 is an enlarged plan view of the construction of the hinge unit and the shock absorber of the hatch cover shown in FIG. 9, with the hatch cover and the attaching member removed.
Figure 11:
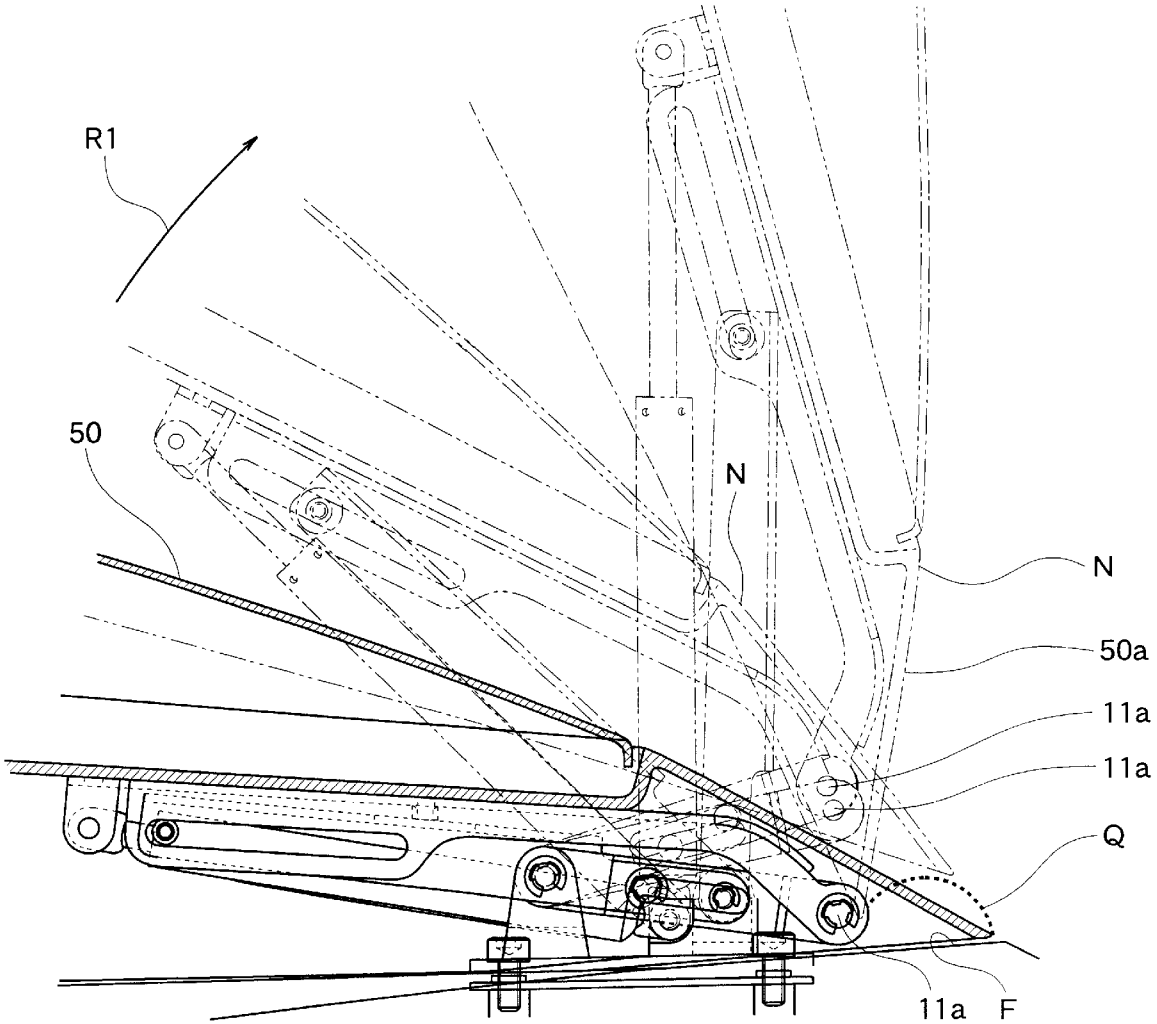
FIG. 11 is a sectional side view of the opening process of the hatch cover according to the embodiment shown in FIGS. 8 to 10.

FIG. 8 is a general perspective view of the hinge unit H for use in the hatch cover structure for the personal watercraft. FIG. 9 is a partially broken side view of the hinge unit with the hatch cover of the embodiment shown in FIG. 8 in a closed state of the hatch cover. FIG. 10 is an enlarged plan view of the hinge unit and a shock absorber of the hatch cover shown in FIG. 9, with the hatch cover and an attaching member removed. FIG. 11 is a sectional side view of the hinge unit H showing the opening process of the hatch cover according to the embodiment shown in FIGS. 8 to 10.

As shown FIG. 8, the hinge unit H has a second link member 14A and a first link member 14B. A fixed end 14A' of the second link member 14A is connected to a fixing member 17 secured on the deck F via a second connecting pin (connecting element) 11*b*, and a free end 14A" of the second link member 14A is connected to an attaching member 15 secured to a hatch cover H via a slide mechanism. In this embodiment, the slide mechanism is composed of an elongated hole 15*a* formed in the attaching member 15 in the longitudinal direction, and a second slide pin 20 adapted to slide in the elongated hole 15*a*. The second slide pin 20 is secured to the free end 14A" of the second link member 14A.

A fixed end 14B' of the first link member 14B is connected via a third connecting pin (connecting element) 11*c* to the fixing member 17 at the position rearwardly away (toward the rear of the deck) from the fixed end 14A' of the link member 14A, and the free end 14B" of the first link member 14B is connected to the attaching member 15 via a first connecting pin (hinge shaft) 11*a*.

An elongated hole (a slot) 18 which extends longitudinally along the first link member 14B is formed in the intermediate portion of the link member 14B. A first slide pin (slider) 19 is slidably arranged in the elongated hole 18. Both the ends of the slide pin 19 are pin-connected to the portion near the bifurcated fixed ends 14A' of the second link member 14A which extend on both sides of the first link member 14B. The link members 14A and 14B are thus connected through the slide pin 19.

Similar to the "Embodiment 1" described above, the progress of the opening action of the hatch cover 50 is shown by the dash and two-dot line N in FIG. 11. The front end of a tip portion 50*a* of the hatch cover 50 rotates around the first connecting pin 11*a* (hinge shaft) by the opening action (rotates clockwise as indicated by the arrow R1 in FIG. 11), however, the front end of the tip portion 50*a* moves upward from the upper surface F of the deck, and moves rearwardly above the upper surface F (see the dotted line Q in FIG. 11). The dimension and connecting position of the link members, 14A, 14B and the position and slide length of the slide members are determined so that the tip may not move into the deck. In the embodiment shown in FIG. 9, when the length of the second link member 14A is 1 inch, the length of the first link member 14B is about 0.5 inch in this embodiment, the distance between connecting positions Sa (11*b*) and Sb (11*c*) on the fixed ends 14A' and 14B' of the second link members 14A and 14B is about 0.3 inch, the distance between the connecting position Sa on the fixed end 14A' of the link member 14A and the slide pin 19 is about 0.13 inch, and the distance from the connecting pin 11*a* to the front end of the hatch cover 50 is about 0.23 inch.

The position and length of the elongated hole 15*a*, and position and length of the elongated hole 18 shown in FIG. 8 are determined by an opening range of the hatch cover 50, i.e., a movement range of the attaching member 15 moved by the link mechanism having the link members of the above-described dimension. The closed position and the fully opened position of the hatch cover 50 are therefore determined by the positions and lengths of the elongated holes 15*a* and 18.

In this embodiment, the link members 14A and 14B, the fixing member 17, and the connecting pins are made of stainless steel, to afford rust-resistant function. However, the materials of these members are not particularly limited. Chrome-plated iron may be alternatively used, and fiber reinforced plastic materials may also be used for members under less load.

A shock absorber 16 is also arranged in this embodiment for damping the opening and closing movement of the hatch cover 50. As seen from its perspective view of FIG. 8, side view of FIG. 9, and plan view of FIG. 10, a shock absorber 16 is attached at the side of the hinge unit H in this embodiment, by attaching the upper end of the shock absorber 16 to the rear end of the attaching member 15 via a connecting pin 21*a*, and the lower end of the shock absorber 16 to the fixing member 17 via a connecting pin 21*b*.

According to the hatch cover structure thus constructed, the structure acts in the following manner. As shown in FIG. 9, small or no gap G is formed between the upper surface F of the deck 100 and the lower end of the hatch cover 50 from its front end to the first connecting pin 11*a* in the "closed state" in which the hatch cover 50 is close to (or in contact with) the upper surface of the deck 100.

For opening the hatch cover 50 from this closed state, the hatch cover 50 tends to rotate around the first connecting pin 11*a* (hinge shaft) arranged on the free end 14B" of the first link member 14B. As the free end 14A" of the second link member 14A rotates clockwise in FIG. 9 with respect to the proximal end (the connecting portion Sa of the first end 14A') associated with the progress of the opening action of the hatch cover 50, the elongated hole 18 moves upward allowing the first link member 14B to be rotated counter-clockwise in FIG. 9 around the connecting portion Sb of the fixed end 14B'. Consequently, the connecting pin 11*a* on the free end 14A" of the first link member 14A gradually moves upward, i.e., in the direction apart from the upper surface F of the deck, with the progress of the opening action. More particularly, in the progress of the opening action of the hatch cover 50 shown by the dash and two-dot line N in FIG. 11, the front end of the tip portion 50*a* of the hatch cover 50 rotates around the connecting pin 11*a* by the opening action (rotating clockwise as indicated by the arrow R1 in FIG. 11) and moves upward at first, and then, moves rearward (see the dotted line Q) above the upper surface F of the deck. Thus, the tip portion 50*a* of the hatch cover 50 does not move into contact with the upper surface F of the deck, unlike the conventional hinge unit without the double action mechanism. Therefore, the hatch cover 50 takes the opening action smoothly relative to the upper surface F of the deck even if the gap G is very small when the hatch cover is closed.

In the hatch cover structure of this embodiment, the hinge unit H is compactly positioned in the tip of the hatch cover 50 when the hatch cover 50 is opened as shown in FIG. 8. The hinge unit H does not hinder the taking in and out of the baggage through an opening 60 under (inside) the hatch cover 50.

In this embodiment, the slide mechanism is composed of the elongated slots 15*a*, 18 and the slide pins 19, 20. However, the slide mechanism may be alternatively composed of any other known slide mechanism, for example, the attaching member 15 and the slider which covers the attaching member 15. The elongated hole 18 of the first link member 14B and the slide pin 19 in the elongated hole 18 may similarly be composed of any other known slide mechanism, for example, the slider which slides on an outer periphery of the link member 14B. In this case, the slider and the link member 14A are connected through the separate connecting pins.

In the above embodiments, description has been directed to the application of the present invention to the hatch cover provided in the bow. However, the invention may be applied to a hatch cover structure in general, for example, an opening and closing mechanism of a seat 70 in the center of the personal watercraft shown in FIG. 1, a hatch cover in a stern, or, a cover h (see FIG. 1) arranged on the hatch cover 50. The same effects as described above are obtained.

According to the hatch cover structure for the personal watercraft of the present invention, a recess is not necessary to be formed in the bow of the hull for avoiding contact between the front end of the hatch cover and the upper surface of the deck, and without producing any noticeable gap between the hatch cover and the hull when the hatch cover is closed. It is therefore possible to provide a hatch cover structure suitable for a personal watercraft whose appearance is regarded as important.

The hatch cover structure has sufficient strength and rigidity to support the hatch cover either in the open state or in the closed state. A smooth action is also obtained when the hatch cover is opened or closed.

Numerous modifications and alternative embodiments of the present invention will be apparent to those skilled in the art in view of the foregoing description. Accordingly, this description is to be construed as illustrative only, and is provided for the purpose of teaching those skilled in the art the best mode of carrying out the invention. The details of the structure and/or function may be varied substantially without departing from the spirit of the invention and all modifications which come within the scope of the appended claims are reserved.

What is claimed is:

1. A personal watercraft formed substantially in a bullet shape comprising:

a hull and a deck disposed thereon, said deck including a bow in a streamlined shape;

a hatch cover having a front extending near the bow and narrowing forwardly into a streamlined shape, said hatch cover pivotally movable with respect to a surface of the deck of the personal watercraft at the bow;

a hinge unit pivotally mounting said hatch cover to said deck surface, said hinge unit having a hinge shaft around which said hatch cover rotates, and said hinge unit mounted within the hatch cover inner space portion at the front end of said hatch cover; and said hinge unit including a double action mechanism which moves said hinge shaft apart from the surface of the deck to move the hatch cover front end upward away from the deck surface during the continued opening action of the pivotally moving hatch cover.

2. A personal watercraft according to claim 1, wherein said double action mechanism comprises:

a gear frame;

a pair of gears which engage each other, and arranged in said gear frame;

a first link member having a fixed end and a free end, said fixed end being secured to one gear of said pair of gears;

a second link member having a fixed end and a free end, said fixed end being secured to the other gear of said pair of gears;

a third link member having a free end and a fixed end, said free end being pivotally connected to said free end of said second link member;

a connecting element disposed at said free end of said first link member, said connecting element defining said hinge shaft;

said gear frame is fixed to the deck surface at the front portion of said deck, and the free end of said first link member and the fixed end of said third link member are respectively pivotally attached to a surface of the hatch cover at the front portion of said hatch cover, whereby the hinge shaft moves apart from the surface of the deck during the continued opening action of the pivotally moving hatch cover.

3. A personal watercraft according to claim 2, wherein an effective length of said first link member is smaller than the sum of the effective lengths of said second and third link members, and said pair of gears have a substantially equal number of teeth.

4. A personal watercraft according to claim 1, wherein an attaching member, which connects said double action mechanism to the hatch cover, is integrally secured to said hatch cover.

5. A personal watercraft according to claim 1, wherein said hinge unit includes an attaching member having one end mounted to said hatch cover and a free end, said attaching member being disposed at the hatch cover center and connecting said double action mechanism to said hatch cover, and wherein said double action mechanism comprises:

a second link member having a fixed end pivotally mounted to said deck surface and a free end slidably coupled to said attaching member;

a first slidable mechanism including a longitudinally extending slot in said one end of said attaching member and a slide pin interconnecting said slot with said second link member free end for slidably coupling said attaching member and said second link member;

a first link member having a fixed end pivotally mounted to said deck surface and a free end pivotally connected to said attaching member free end, said pivotal connection defining said hinge shaft;

a second slidable mechanism slidably coupling said first and second link members, including a longitudinally extending slot in said first link member intermediate said fixed end and said free end and a second slide pin interconnecting said slot and said second link member at a point intermediate said second link member fixed end and said free end;

whereby the hinge shaft moves apart from the surface of the deck during the continued opening action of the pivotally moving hatch cover.

6. A personal watercraft according to claim 5, wherein said attaching member one end is integrally secured to said hatch cover.

* * * * *

UNITED STATES PATENT AND TRADEMARK OFFICE

CERTIFICATE OF CORRECTION

PATENT NO. : 6,308,650 B1 
DATED : October 30, 2001
INVENTOR(S) : Yoshinori Tsumiyama et al.

It is certified that error appears in the above-identified patent and that said Letters Patent is hereby corrected as shown below:

Column 9,
Line 17, after "mechanism which" insert -- initially --; and
Line 19, after "deck surface" insert -- and subsequently rearwardly away from the bow above the deck surface --.

Signed and Sealed this

Seventeenth Day of June, 2003

JAMES E. ROGAN
*Director of the United States Patent and Trademark Office*